US008210192B1

(12) United States Patent
Monnin et al.

(10) Patent No.: US 8,210,192 B1
(45) Date of Patent: Jul. 3, 2012

(54) OSCILLATING WASHBOX FOR CYLINDER HEAD UTILIZING ECHELON FORMATION NOZZLE ALIGNMENT AND AN IMPROVED NOZZLE PLATE DESIGN

(75) Inventors: Thad A. Monnin, Russia, OH (US); Aaron M. Brunswick, Burkettsville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 534 days.

(21) Appl. No.: 12/413,964

(22) Filed: Mar. 30, 2009

(51) Int. Cl.
*B08B 3/12* (2006.01)
*B08B 6/00* (2006.01)

(52) U.S. Cl. ..... 134/198

(58) Field of Classification Search ..... 134/198
See application file for complete search history.

(56) References Cited

U.S. PATENT DOCUMENTS

| | | | | |
|---|---|---|---|---|
| 3,142,306 | A * | 7/1964 | Boka, Jr. | 134/166 R |
| 4,993,444 | A * | 2/1991 | Toriyama et al. | 134/181 |
| 5,228,625 | A * | 7/1993 | Grassberger | 239/558 |
| 2006/0102756 | A1 * | 5/2006 | Calvin et al. | 239/587.3 |
| 2006/0273192 | A1 * | 12/2006 | Markley et al. | 239/206 |
| 2007/0200013 | A1 | 8/2007 | Hsiao | |
| 2009/0038638 | A1 * | 2/2009 | Cheng et al. | 134/1.3 |

* cited by examiner

*Primary Examiner* — Michael Barr
*Assistant Examiner* — David Cormier
(74) *Attorney, Agent, or Firm* — Rankin Hill & Clark LLP

(57) ABSTRACT

A bottom wall, a pitched top wall, and sidewalls cooperate to define a washbox for washing a part. The pitched top wall has an interior surface and an exterior surface. The exterior surface is pitched with a maximum distance from the bottom wall at a peak of the pitched top wall. The exterior surface is smooth and free from projections. The washbox further includes ports that extend through the sidewalls to provide fluid to the washbox. A plurality of bores extend through the pitched top wall and are arranged in a row echelon pattern for spraying the part.

20 Claims, 7 Drawing Sheets

OSCILLATING WASHBOX FOR CYLINDER HEAD UTILIZING ECHELON FORMATION NOZZLE ALIGNMENT AND AN IMPROVED NOZZLE PLATE DESIGN

FIELD OF THE INVENTION

The presently disclosed embodiments are directed to the field of parts cleaning and, more particularly toward a method and apparatus with an improved nozzle plate for cleaning the parts.

BACKGROUND

During the manufacture of metallic and plastic parts, a variety of sequential machining operations are performed to create the parts. These machining operations may include turning, drilling, milling, shaping, planing, boring, broaching, and sawing. During these operations, waste chips are generated. Additionally, various coolants and lubricants may be used during these operations that subsequently remain on the part. The waste chips and leftover coolants and/or lubricants may have a negative impact on the quality of the part. Thus, it is important to remove waste chips and fluids from the finished part.

Parts may be subjected to a parts washing between or after the machining operations. A parts washer sprays a fluid on the part to remove the waste chips and/or the leftover fluids. To increase the effectiveness of the parts washer, compressed air may be supplied as a carrier for the fluid to further increase the spray pressure.

Known parts washers are typically comprised of a horizontal fluid supply pipe with a plurality of nozzles extending from the horizontal pipe toward the part to be washed. The fluid and air mixture is fed through the nozzles and sprayed at the part. As the waste chips are dislodged from the part, they tend to accumulate between the nozzles on the horizontal pipe. Over time, the accumulated waste chips fill in any spaces on the horizontal pipe between the nozzles. This accumulation of waste chips continues until the parts washer is cleaned or the nozzles become obstructed and the parts washer must be shut down. Cleaning of the parts washer requires shutting down the washer, thereby impacting productivity and requiring additional labor for cleaning the parts washer.

The use of compressed air as a carrier for the fluid also has numerous drawbacks. For example, by adding pressurized air to the fluid, the combined air/fluid mixture is more atomized, increasing the amount of fluid that becomes airborne. The increased amount of airborne fluid may require increased ventilation and masking in the area of the parts washer.

Therefore, there exists a need in the art for a parts washer that addresses the accumulation of waste chips and which avoids problems associated with the use of compressed air.

SUMMARY

The present invention is directed toward an apparatus and method that allows a part to be washed without waste chips from the part collecting on the parts washer.

More specifically, the apparatus includes a washbox having a bottom wall, a pitched top wall, and sidewalls. The pitched top wall has an interior surface and an exterior surface. The exterior surface is pitched such that a maximum distance from the bottom wall to the pitched top wall occurs at a peak of the pitched top wall. The exterior surface is smooth and free from projections. The side walls define ports through which fluid is provided to the washbox. A plurality of bores extend through the pitched top wall and are arranged in a row echelon pattern. The part to be washed is disposed so that the pitched top wall is between the part and the bottom wall. Fluid that enters the washbox through the ports leaves through the bores and is sprayed onto the part. The chips dislodged from the part are prevented from accumulating on the pitched top wall of the washbox, thereby allowing continued operation of the parts washer.

As will be realized, the invention is capable of other and different embodiments and its several details are capable of modifications in various respects, all without departing from the invention. Accordingly, the drawings and description are to be regarded as illustrative and not restrictive.

BRIEF DESCRIPTION OF THE DRAWINGS

These and further features of the invention will be apparent with reference to the following description and drawings, wherein.

DETAILED DESCRIPTION

Figure 1:
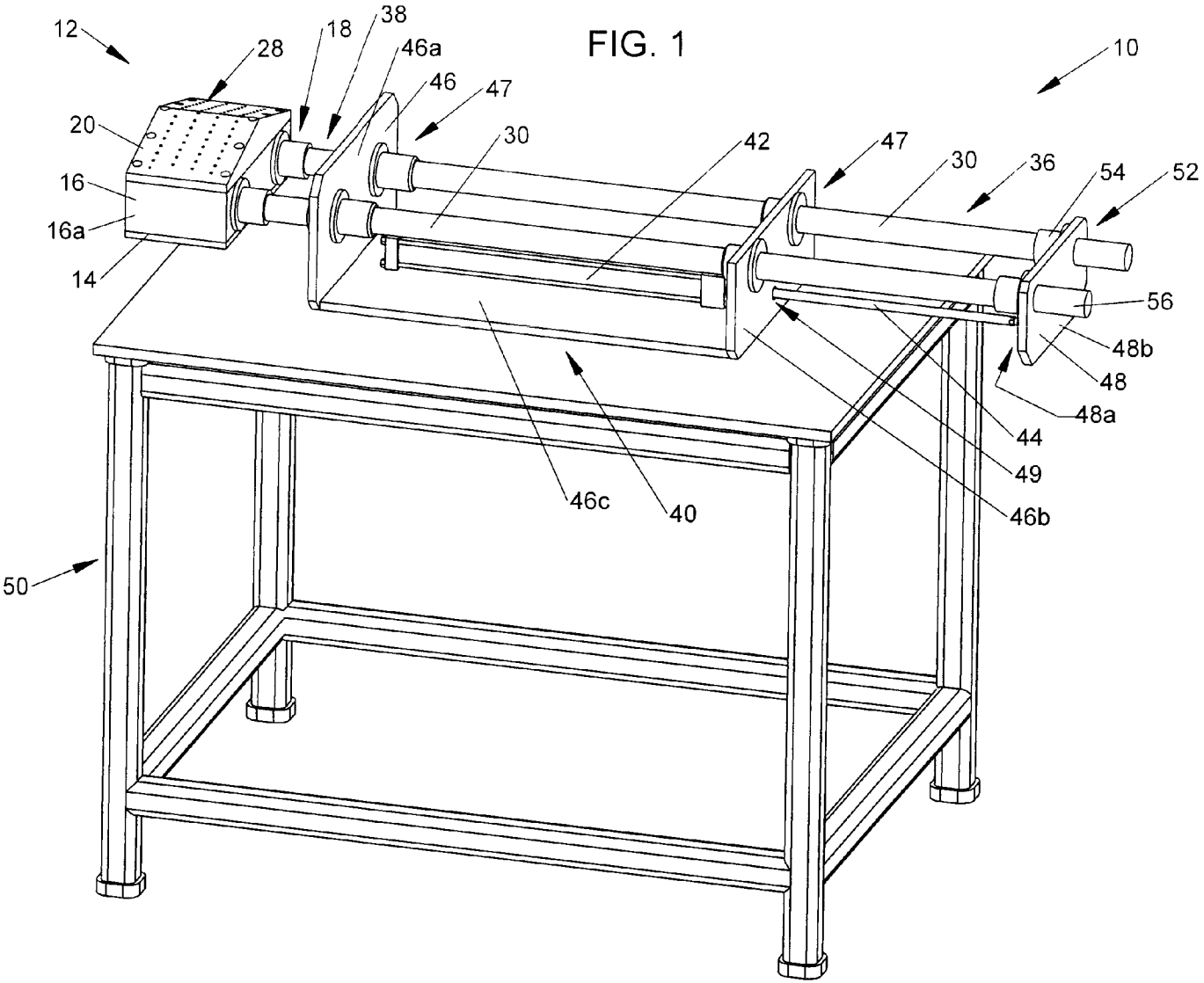
FIG. 1 shows the general configuration of an embodiment in a retracted position in perspective view.

With reference to FIGS. 1-7, a parts washer 10 includes a washbox 12, supply lines 30, and a movement device 40. The washbox 12 includes a bottom wall 14, sidewalls 16, and a pitched top wall 20. The bottom wall 14 is generally rectangular in shape.

The sidewalls 16 include end walls 16*a*, a front wall 16*b*, and a rear wall 16*c*. The end walls 16*a* are planar and solid, as is the rear wall 16*c*. The front wall 16*b*, which faces the movement device 40, has a pair of ports 18 formed therein. The ports 18 permit fluid to be introduced into the interior of the washbox 12, as will be discussed hereinafter.

The pitched top wall 20 has a planar interior surface 24 and a non-planar exterior surface 26. The interior surface 24 faces toward the bottom wall 14, while the exterior surface 26 faces away from the bottom wall 14. The pitched top wall 20 has a pair of planar, upwardly sloping sections that form the exterior surface 26 and meet at a midpoint line that define a peak 22. While the sidewalls 16 and pitched top wall 20 are illustrated as being attached to one another with fasteners, other methods of attachment are possible and contemplated. For example, high strength adhesives could be used to bond the components together. Additionally, while the pitched top wall 20, the bottom wall 14, and the sidewalls 16 are shown as separate components, it is understood that they could instead be an integral assembly made of one or more subassemblies.

A series of bores 28 extend vertically and completely through the pitched top wall 20 generally perpendicularly relative to the interior surface 24. As such, the bores 28 are at an angle to the exterior surface 26. Each of the bores 28 include a large diameter portion 34 adjacent the interior surface 24 and a small diameter portion 32 extending from an upper end of the large diameter portion 34 to the exterior surface 26.

This results in the exterior surface 26 of the pitched top wall 20 being smooth and free from projections so as to resist the build up of waste chips. As illustrated, there are five rows of bores 28. However, more or less rows of bores are possible and contemplated. Inspection of FIG. 3 reveals that the bores 28 are in a row echelon pattern. This pattern ensures that the part 58 is completely exposed to the fluid upon movement of the washbox 12.

The supply lines 30 each have a proximal or inlet end 36 secured to a driven plate 48 of the movement device 40 and distal or outlet end 38 secured to the front wall 16*c* of the washbox 12.

The movement device 40 includes a driver 42, a driven shaft 44, a bracket 46, and the driven plate 48. The movement device 40 is mounted upon a supporting table 50. The bracket 46 is generally U-shaped, including a forward arm 46*a*, a rearward arm 46*b*, and a base plate 46*c* extending between the forward and rearward arms 46*a*, 46*b* and affixed to the table 50. The forward and rearward arms 46*a*, 46*b* include a pair of aligned openings 47 through which the supply lines 30 coaxially extend. The openings 47 have bushings or the like to reduce frictional engagement as the lines 30 slide through the openings 47. The rearward arm 46*b* also has an opening 49 though which the driven shaft 44 extends. While the bracket 46 is shown as being a separate component from the table 50, the bracket 46 could alternatively be integral with the table 50.

The movement device driver 42 is a servomechanism or a hydraulic cylinder, as is known in the art for providing linear movement. The movement device driver 42 is attached to the bracket 46 and the driven shaft 44 extends from the driver 42, through the rearward arm 46*b*, and is connected to a first side of the driven plate 48. The driven plate 48 is also connected to the supply lines 30.

The driven plate 48 has a first side 48*a*, facing toward the rearward arm 46*b*, and an oppositely disposed second side 48*b*. A pair of openings 52 formed in the driven plate 48 are aligned with the openings 47 in the forward and rearward arms 46*a*, 46*b*. More specifically, flanged couplings 54 at the inlet end 36 of the supply lines 30 are affixed to the first side 48*a* of the driven plate 48 so as to surround the openings 52 and mechanically fix the driven plate 48 to the supply lines 30 such that the driven plate 48 and supply lines 30 move together. A pair of mounting stubs 56 are threadably inserted into the openings 52 and serve as connections for flexible fluid supply tubes to provide pressurized fluid to the supply lines 30, as discussed hereinafter.

Figure 2:
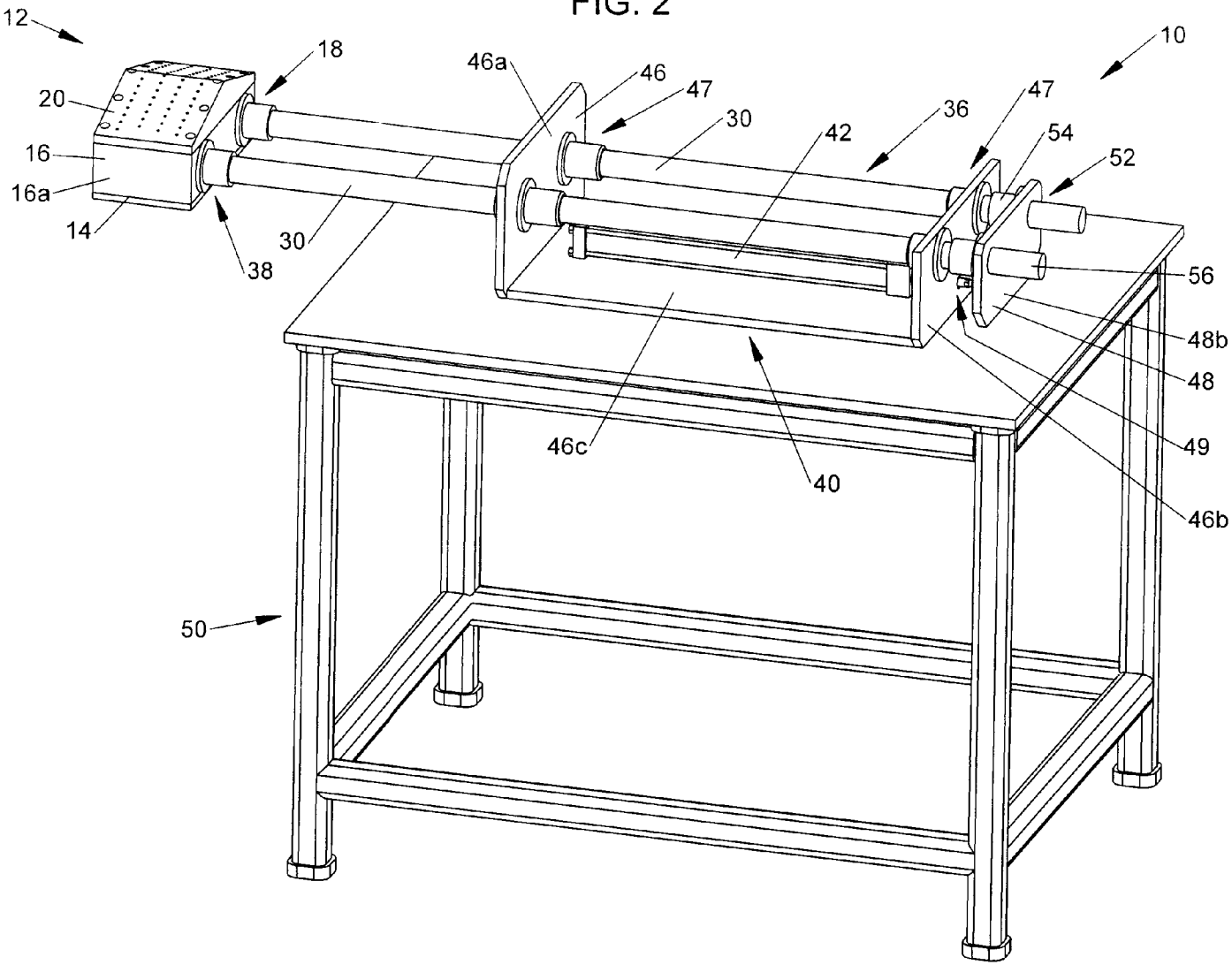
FIG. 2 shows the general configuration of the embodiment in an extended position in perspective view.

Therefore, as is shown in FIG. 1, extension of the driven shaft 44 causes the washbox 12 to retract. As is shown in FIG. 2, retraction of the driven shaft 44 causes the washbox 12 to extend. This extension and retraction of the washbox 12 allows for fluid to make contact with the part and loosen any waste chips from the part. Furthermore, it allows the washbox 12 to be used to effectively clean parts that are longer than the washbox 12.

Figure 4:
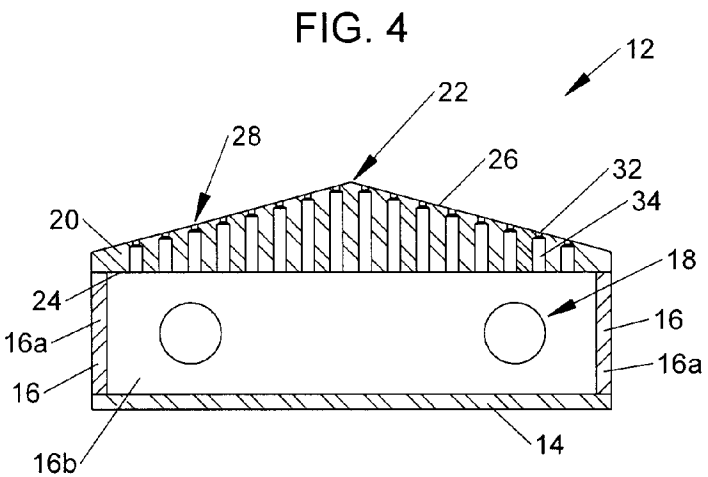
FIG. 4 is a cross sectional view of FIG. 3 along lines 4-4.
Figure 3:
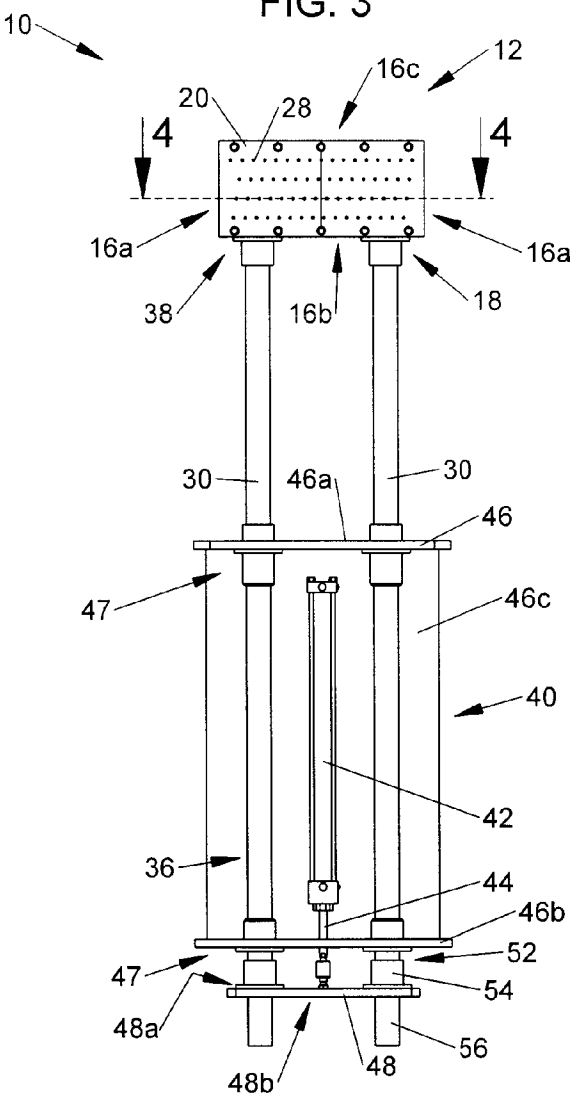
FIG. 3 is a plan view of the embodiment.

As can be seen from FIG. 4, the distance between the interior and exterior surfaces 24, 26 increases when traveling from the sidewalls 16 toward the peak 22. Although not illustrated, is it considered apparent that the pitched top wall 20 could be constructed with different layouts.

Figure 5:
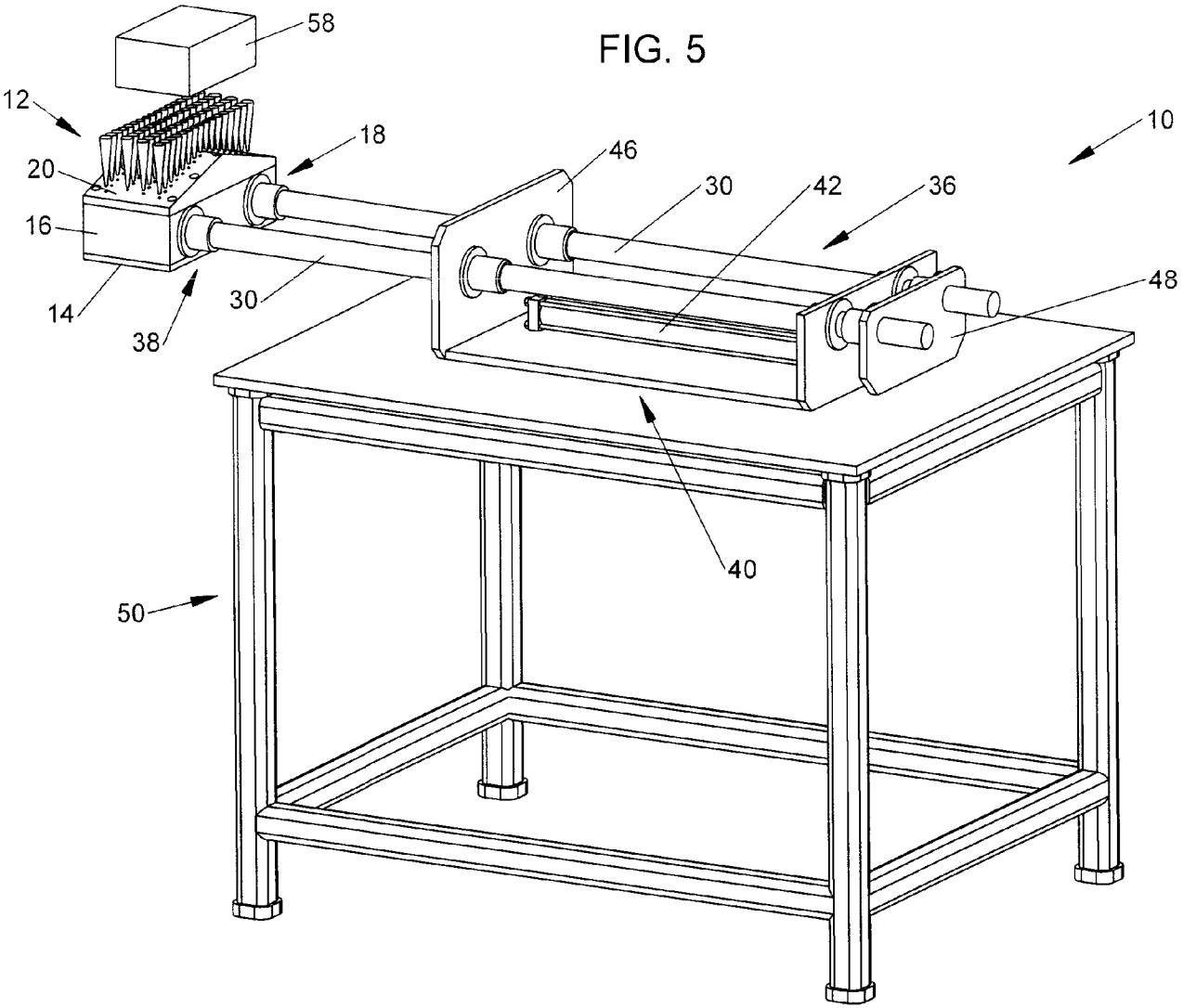
FIG. 5 is a perspective view of the embodiment in operation.
Figure 6:
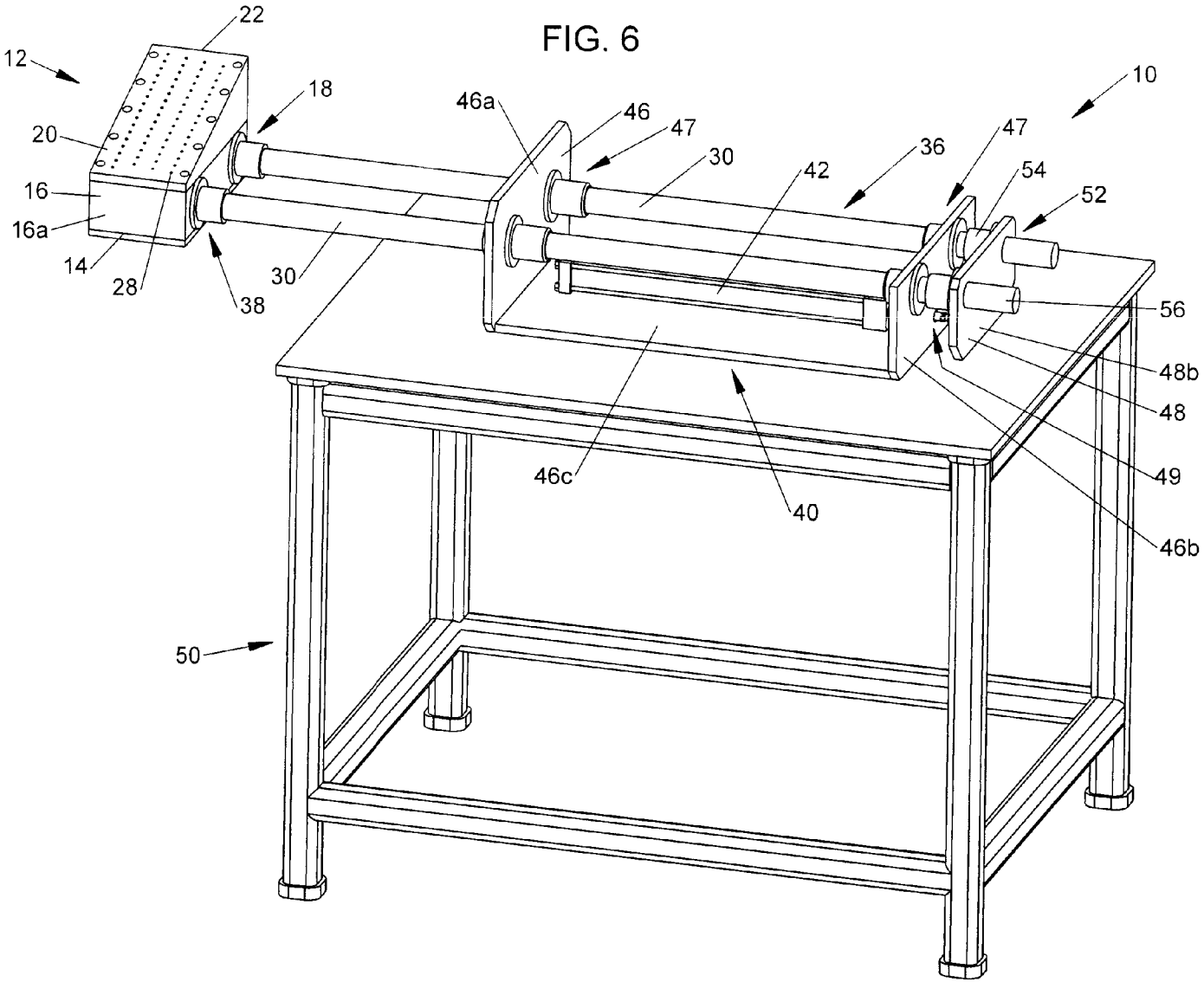
FIG. 6 is a perspective view of the embodiment with an alternate top wall.
Figure 7:
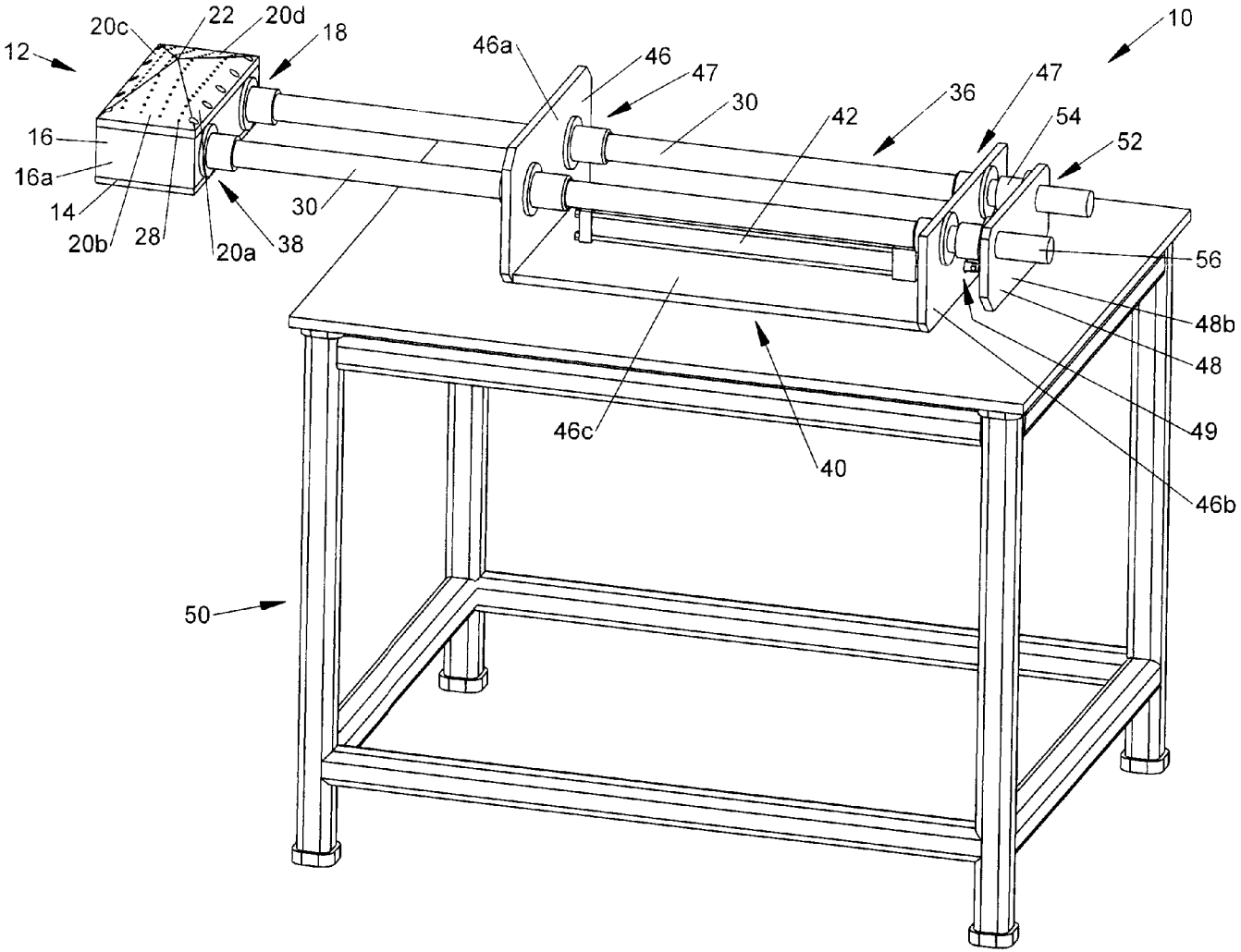
FIG. 7 is a perspective view of the embodiment with a further alternate top wall.

For example, as is shown in FIG. 6, the pitched top wall 20 could instead be constructed so as to only increase in thickness when traveling from one of the sidewalls 16 and not to decrease in thickness when traveling toward the opposing sidewall. This results in the pitched top wall 20 having a single face. In this instance, the pitched top wall 20 is pitched so as to be at a maximum distance from the bottom wall 14 at the peak 22. From an elevational view, this example would look like a shed roof. In comparison, the pitched top wall 20 that is illustrated in FIGS. 1-5 looks like a gable roof from an elevational view. Further still, as is shown in FIG. 7, the pitched top wall 20 could be shaped like a pyramid/cone (e.g. hip roof). This results in the pitched top wall 20 having four faces 20*a*, 20*b*, 20*c*, 20*d*. Each face 20*a*, 20*b*, 20*c*, 20*d* is pitched so as to be at a maximum distance from the bottom wall 14 at the peak 22. It is noted that the pitch of all of the top walls 20 shown in the figures further helps to prevent the waste chips from accumulating on the exterior surface 26 of the washbox 12.

Furthermore, while the pitched top wall 20 is illustrated as varying in thickness, the pitched top wall 20 could instead be of uniform thickness. In that instance, instead of the interior surface 24 being generally parallel to the bottom wall 14, the interior surface 24 would instead be generally parallel to the exterior surface 26, but the pitched top wall 20 would have the same pitch as the illustrated embodiment.

While the illustrated embodiment includes two supply lines 30, it is considered apparent that more or less than two supply lines 30 could be used to provide the fluid to fill the washbox 12. Additionally, the sum of the cross-sectional areas of the small diameter sections 32 of the bores 28 is less than the sum of the cross-sectional area of the ports 18. This dimensional difference will provide additional fluid pressure for dislodging the waste chips from the part. Furthermore, while it is only shown that the supply lines 30 enter the washbox though the sidewall 16, entry thought the bottom wall 14 is also possible and contemplated. Finally, although not illustrated, it is understood that numerous gaskets or other types of sealing components would be employed with the parts washer 10 so as to minimize fluid from exiting from any location other than the bores 28.

As shown in FIG. 5, the part 58 to be washed would be situated so that the exterior surface 26 of the pitched top wall 20 of the washbox 12 would be between the part 58 and the bottom wall 14. The spray is illustrated with dashed lines from the washbox 12 to the part 58. The part 58 is fixtured by commercially known means. The part 58 may be larger or smaller than the washbox 12. As will be discussed below, because the washbox 12 extends and retracts and the row echelon layout of the bores 28, the fluid from the washbox 12 will make contact with all portions of the part 58 even when the part 58 is longer than the washbox 12. This results in more waste chips being dislodged from the part 58.

Figure 8:
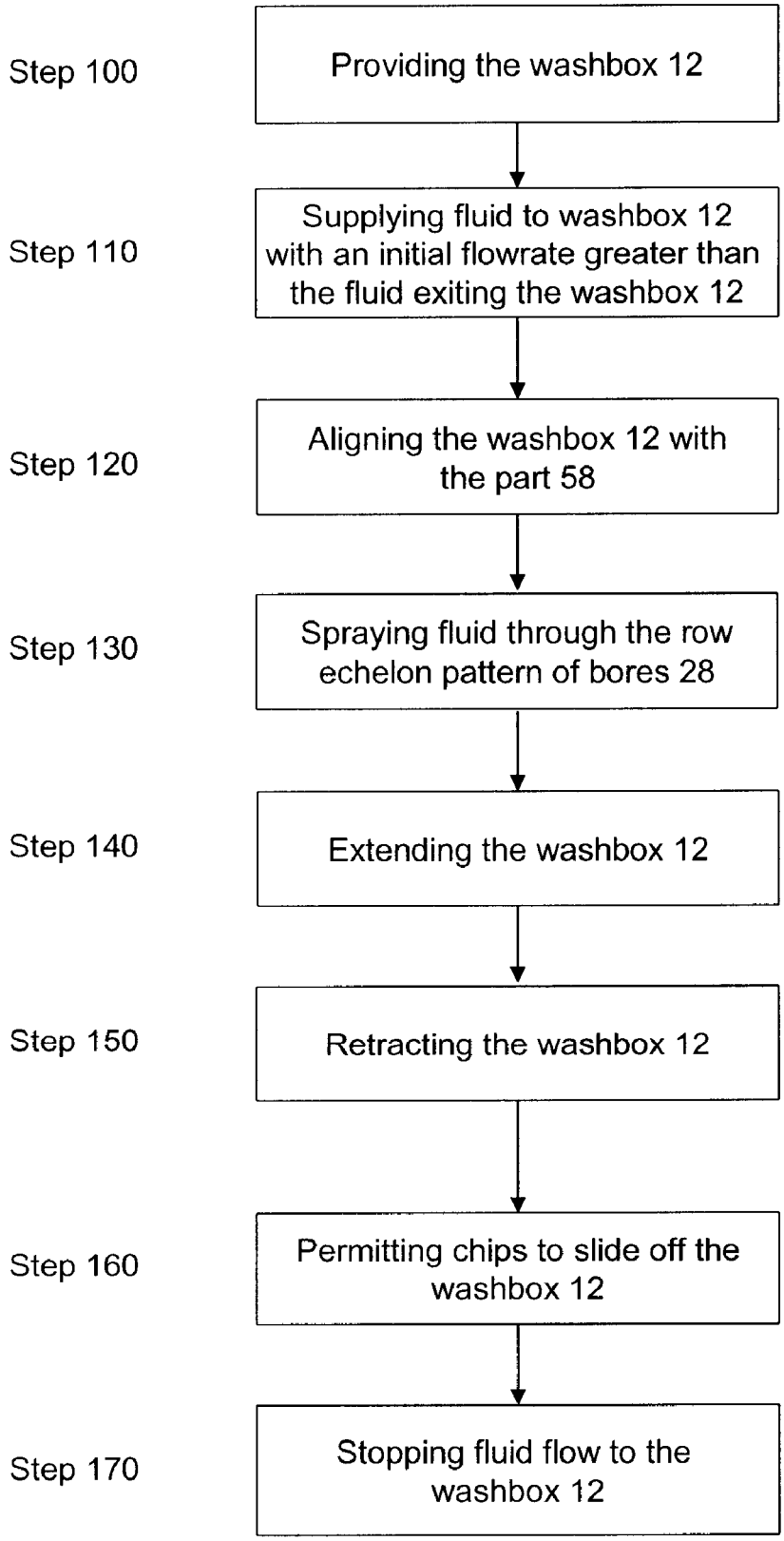
FIG. 8 is a flowchart outlining a method of parts washing.

A method of washing a part is illustrated in FIG. 8. In Step 100, the washbox 12 with pitched top wall 20 and bores 28 in a row echelon pattern is provided. Then, to fill the washbox 12, fluid is initially supplied to the washbox 12 with a flow rate greater than a flow rate of the fluid exiting the bores 28 (Step 110). In Steps 120 and 130, the washbox 12 is aligned with the part 58 and fluid is sprayed thought the row echelon bores 28 toward the part 58. Then, the washbox 12 is extended and retracted along a common plane (Steps 140, 150). In Steps 160 and 170, the waste chips are permitted to slide off of the washbox 12 and the fluid being supplied to the washbox 12 is stopped.

While, for purposes of simplicity of explanation, the method has steps shown and described as executing serially, it is to be understood and appreciated that the present invention is not limited by the illustrated order, as some steps could occur in different orders and/or concurrently with other steps from that shown and described herein. For example, the chips are permitted to slide off of the washbox 12 during all steps of the method. Additionally, Steps 140 and 150 may be repeated a plurality of times so as to wash the part 58 multiple times.

Many other benefits will no doubt become apparent from future application and development of this technology. As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A parts washer, comprising:

a bottom wall;

a plurality of sidewalls extending from the bottom wall, at least one of the sidewalls defining a plurality of ports; and a pitched top wall connecting the plurality of sidewalls, the top wall including an interior surface facing toward the bottom wall and an exterior surface facing away from the bottom wall, the top wall defining a plurality of bores arranged in a row echelon pattern in fluid communication with the plurality of ports, the exterior surface of the top wall including four pitched triangular shaped faces that each have an upwardly directed vertex, wherein the vertices of the triangular shaped faces cooperate to form a peak of the top wall that defines a maximum distance of the top wall being offset from the bottom wall.

2. The parts washer of claim 1, wherein a distance between the interior surface and the exterior surface increases from the sidewalls toward the peak of the pitched top wall.

3. The parts washer of claim 1, wherein the bores each include a large diameter section and a small diameter section, the large diameter section extending from the interior surface toward the exterior surface and merging into the small diameter section, and the small diameter section extending from the large diameter section to the exterior surface.

4. The parts washer of claim 1, the bottom wall, the sidewalls, and the top wall cooperating to define a washbox, the parts washer further including a movement device that moves the washbox, the movement device including a driver that is moveable in a first direction to extend the washbox and movable in a second direction to retract the washbox.

5. The parts washer of claim 4, wherein outlet sides of a plurality of supply lines are connected to the ports to provide fluid to the washbox and inlet sides of the plurality of supply lines are attached to a plate driven by the driver.

6. The parts washer of claim 5, wherein the driver of the movement device is attached to a bracket that has aligned openings for slidable receipt of the supply lines, and a driven shaft extends from the driver of the movement device to the plate.

7. The parts washer of claim 5, wherein the supply lines are operable to slidably drive the washbox.

8. A parts washer, comprising:

a bottom wall;

at least one sidewall extending from the bottom wall, the at least one sidewall defining at least one port; and a pitched top wall connected to the at least one sidewall, the top wall including an interior surface facing toward the bottom wall and an exterior surface facing away from the bottom wall, the top wall defining a plurality of bores extending through the pitched top wall and in fluid communication with the at least one port, the exterior surface of the top wall including four pitched triangular shaped faces that each have an upwardly directed vertex, wherein the vertices of the triangular shaped faces cooperate to form a peak of the top wall that defines a maximum distance of the top wall being offset from the bottom wall.

9. The parts washer of claim 8, wherein a sum of a cross-sectional area of the bores is less than a cross-sectional area of the port.

10. The parts washer of claim 8, wherein the plurality of bores are arranged in a row echelon pattern in the pitched top wall.

11. The parts washer of claim 8, wherein a distance between the interior surface and the exterior surface increases from the sidewall toward the peak of the pitched top wall.

12. The parts washer of claim 8, wherein the bores each include a large diameter section and a small diameter section, the large diameter section extending from the interior surface toward the exterior surface and merging into the small diameter section, and the small diameter section extending from the large diameter section to the exterior surface.

13. The parts washer of claim 8, the bottom wall, the at least one sidewall, and the top wall cooperating to define a washbox, the parts washer further including a movement device that moves the washbox, the movement device including a driver that is moveable in a first direction to extend the washbox and movable in a second direction to retract the washbox.

14. The parts washer of claim 13, wherein an outlet side of a supply line is connected to the port to provide fluid to the washbox and an inlet side of the supply line is attached to a plate driven by the driver, wherein movement of the driven plate causes corresponding movement of the supply line and the washbox.

15. The parts washer of claim 14, wherein the driver of the movement device is attached to a bracket that has aligned openings for slidable receipt of the supply lines, and a driven shaft extends from the driver of the movement device to the plate.

16. The parts washer of claim 15, wherein the bracket is attached to a table.

17. The parts washer of claim 1, further including a plurality of supply lines being fluidly connected to the plurality of ports of the sidewalls, and a base plate connecting a forward arm to a rearward arm to form a U-shaped bracket, the forward arm and the rearward arm each defining openings that slidable receive the plurality of supply lines.

18. The parts washer of claim 17, further including a driver and a driven shaft that are adapted to move the sidewalls toward and away from the forward arm, and a driven plate connecting the driven shaft to the supply lines, the rearward arm being longitudinally disposed between the driven plate and the forward arm.

19. The parts washer of claim 8, further including at least one supply line being fluidly connected to the port of the sidewall, and a base plate connecting a forward arm to a rearward arm to form a U-shaped bracket, the forward arm and the rearward arm each defining at least one opening for slidable receipt of the supply line, the rearward arm also defining a driven shaft opening slidably receiving a driven shaft adapted to move the sidewall toward and away from the forward arm.

20. The parts washer of claim 19, wherein the port and the at least one opening of the forward arm and the rearward arm are in registry.

* * * * *